US011964191B2

(12) United States Patent
Greaney et al.

(10) Patent No.: US 11,964,191 B2
(45) Date of Patent: Apr. 23, 2024

(54) GOLF CLUB

(71) Applicant: Taylor Made Golf Company, Inc., Carlsbad, CA (US)

(72) Inventors: Mark Vincent Greaney, Vista, CA (US); Andrew Kickertz, San Diego, CA (US); Todd P. Beach, Encinitas, CA (US); Craig Richard Slyfield, San Diego, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 1130 days.

(21) Appl. No.: 16/352,537

(22) Filed: Mar. 13, 2019

(65) Prior Publication Data

US 2019/0232121 A1 Aug. 1, 2019

Related U.S. Application Data

(63) Continuation of application No. 16/046,106, filed on Jul. 26, 2018, now abandoned, which is a continuation of application No. 15/197,551, filed on Jun. 29, 2016, now Pat. No. 10,052,530.

(60) Provisional application No. 62/185,882, filed on Jun. 29, 2015.

(51) Int. Cl.

| | |
|---|---|
| ***A63B 53/04*** | (2015.01) |
| ***A63B 60/42*** | (2015.01) |
| ***A63B 71/06*** | (2006.01) |

(52) U.S. Cl.

CPC ..... *A63B 53/0466* (2013.01); *A63B 71/0619* (2013.01); *A63B 53/0437* (2020.08); *A63B 53/0441* (2020.08); *A63B 60/42* (2015.10)

(58) Field of Classification Search

CPC . A63B 53/0466; A63B 71/0619; A63B 60/42; A63B 53/0437; A63B 53/0441

USPC ..... 473/221–224

See application file for complete search history.

(56) References Cited

U.S. PATENT DOCUMENTS

| | | | |
|---|---|---|---|
| 1,291,967 | A | 1/1919 | McDougal |
| 1,402,537 | A | 1/1922 | Reach |
| 1,660,126 | A | 2/1928 | Heeter |
| D89,332 | S | 10/1930 | Bartsch |
| 2,908,504 | A | 11/1958 | Pratt |
| 2,934,347 | A | 4/1960 | Siniscalchi |
| 2,954,231 | A | 9/1960 | Macintyre |

(Continued)

OTHER PUBLICATIONS

AdamsGolf, "DiXX Blu Putter," retrieved from https://web.archive.org/web/20080913151800/http://www.adamsgolf.com/products/shortgame/dixx.php, document dated Sep. 13, 2008, 1 page.

(Continued)

*Primary Examiner* — Sebastiano Passaniti

(74) *Attorney, Agent, or Firm* — Klarquist Sparkman, LLP

(57) ABSTRACT

A golf club head is provided with an electronic display that is visible to a user of the golf club head when the golf club head is in the address position, such as for displaying one or more images to the user. The electronic display may include a memory, a microprocessor, and a battery, and may be configured to communicate with a user operable electronic device via a wired or a wireless communication protocol. For example, the electronic display may be configured to receive one or more images from the user operable electronic device, to store the one or more images in the memory, and to display the one or more images to the user.

31 Claims, 12 Drawing Sheets

(56) References Cited

U.S. PATENT DOCUMENTS 3,753,564 A 8/1973 Brandell
D231,624 S 5/1974 Wilmoth
D237,289 S 10/1975 Calton
4,157,830 A 6/1979 Taylor et al.
5,131,660 A * 7/1992 Marocco ..... A63B 69/3685 473/223
5,213,328 A 5/1993 Long et al.
5,433,446 A 7/1995 Lindstedt, Jr.
5,489,094 A 2/1996 Pritchett
5,776,011 A 7/1998 Su et al.
5,788,584 A 8/1998 Parente et al.
5,935,020 A 8/1999 Stites et al.
6,196,932 B1 * 3/2001 Marsh ..... A63B 60/46 473/409
6,248,024 B1 6/2001 Nelson et al.
6,729,967 B2 5/2004 Ford
D496,084 S 9/2004 Imamoto
D505,701 S 5/2005 Dogan
6,929,565 B2 8/2005 Nakahara
6,969,326 B2 11/2005 De Shiell et al.
7,022,030 B2 4/2006 Best
D529,564 S 10/2006 Grace
7,166,038 B2 1/2007 Williams et al.
7,235,021 B2 6/2007 Solheim
7,303,487 B2 12/2007 Kumamoto
7,344,451 B2 3/2008 Tang
7,377,858 B2 5/2008 Kubota
7,396,289 B2 7/2008 Soracco
7,422,531 B2 * 9/2008 Tarng ..... A63B 63/00 273/129 K
7,481,715 B2 1/2009 Byrne
7,510,481 B2 3/2009 Sevon
7,828,669 B1 11/2010 Stites
7,993,216 B2 8/2011 Lee
8,025,589 B2 9/2011 Brinton
8,083,612 B2 12/2011 Stites et al.
8,096,896 B2 1/2012 De Schiell et al.
8,210,960 B1 * 7/2012 Davenport ..... A63B 24/0006 473/409
8,257,191 B2 * 9/2012 Stites ..... A63B 69/36 473/223
8,348,780 B2 1/2013 Stites
8,353,786 B2 1/2013 Beach et al.
8,414,410 B1 4/2013 Flaherty et al.
8,449,402 B2 * 5/2013 Jaekel ..... A63B 24/0021 473/223
8,556,742 B2 10/2013 John
8,636,609 B2 1/2014 Chao et al.
8,690,700 B2 4/2014 Flaherty et al.
8,721,471 B2 5/2014 Albertsen et al.
8,727,909 B2 5/2014 Guerrette et al.
8,821,312 B2 9/2014 Burnett et al.
8,827,831 B2 9/2014 Burnett et al.
9,011,267 B2 4/2015 Burnett et al.
9,056,230 B2 6/2015 Golden et al.
9,089,749 B2 7/2015 Burnett et al.
9,168,428 B2 10/2015 Albertsen et al.
9,168,434 B2 10/2015 Burnett et al.
9,174,101 B2 11/2015 Burnett et al.
9,333,400 B2 5/2016 Girard et al.
D767,694 S 9/2016 Nielson
9,604,136 B1 * 3/2017 Ricky ..... A63B 69/3623
9,662,548 B2 5/2017 Guerrette et al.
9,750,991 B2 9/2017 Chao et al.
9,962,582 B2 5/2018 Antku
10,052,530 B2 8/2018 Greaney et al.
10,065,084 B2 9/2018 Myrhum et al.
10,065,090 B2 9/2018 Guerrette et al.
10,099,102 B1 * 10/2018 Koo ..... G09B 19/0038
10,155,145 B2 12/2018 Girard et al.
10,195,497 B1 2/2019 Greaney et al.
10,207,160 B2 2/2019 Johnson et al.
10,207,171 B2 * 2/2019 Davenport ..... A63B 60/46
10,293,219 B2 5/2019 Hayashi
10,300,351 B2 5/2019 Greaney et al.
D857,816 S 8/2019 Bazzel
10,391,369 B2 8/2019 Greaney et al.
10,413,784 B2 9/2019 Beach et al.
10,463,927 B2 11/2019 Bovee et al.
10,561,922 B2 * 2/2020 Sanchez ..... A63B 69/362
10,576,335 B2 3/2020 Greaney et al.
10,632,350 B2 4/2020 Beach et al.
10,751,585 B2 8/2020 Johnson et al.
10,799,778 B2 10/2020 Guerrette et al.
10,843,053 B2 * 11/2020 Carter ..... A63B 53/08
10,874,922 B2 12/2020 Harbert et al.
10,888,746 B1 1/2021 Greaney et al.
11,045,696 B2 6/2021 Burnett et al.
11,179,608 B2 11/2021 Greaney et al.
2003/0130059 A1 * 7/2003 Billings ..... A63B 53/04 473/332
2003/0203762 A1 * 10/2003 Ross ..... A63B 69/3635 473/151
2005/0187028 A1 * 8/2005 Chang ..... A63B 53/0487 473/238
2005/0209021 A1 9/2005 Hoffman et al.
2007/0004524 A1 * 1/2007 Harrison ..... A63B 60/00 473/238
2007/0026958 A1 * 2/2007 Barasch ..... A63B 69/36 473/266
2007/0232409 A1 10/2007 Byrne
2008/0009344 A1 * 1/2008 Graham ..... G07F 17/3239 463/16
2008/0015045 A1 1/2008 Payne et al.
2009/0314398 A1 12/2009 Shaar
2010/0066677 A1 * 3/2010 Garrett ..... G06F 1/169 345/173
2010/0093458 A1 * 4/2010 Davenport ..... A63B 53/0466 473/223
2010/0130298 A1 * 5/2010 Dugan ..... A63B 24/0006 473/409
2010/0173720 A1 7/2010 Kim
2010/0248852 A1 * 9/2010 Lee ..... A63B 60/62 473/223
2011/0081982 A1 4/2011 John
2011/0159986 A1 6/2011 Chao et al.
2014/0057738 A1 2/2014 Albertsen et al.
2014/0127659 A1 * 5/2014 Barasch ..... A63B 69/36 434/252
2014/0179460 A1 6/2014 Beach et al.
2014/0206469 A1 7/2014 Girard et al.
2014/0213390 A1 7/2014 Guerrette et al.
2014/0228153 A1 8/2014 Albertsen et al.
2014/0260637 A1 * 9/2014 Molinari ..... A63B 37/0003 73/646
2014/0274446 A1 9/2014 Greaney et al.
2014/0342848 A1 11/2014 Burnett et al.
2014/0371002 A1 12/2014 Burnett et al.
2014/0373630 A1 * 12/2014 Taniguchi ..... A63B 69/3632 248/220.21
2015/0182822 A1 7/2015 Burnett et al.
2015/0231455 A1 8/2015 Burnett et al.
2016/0016054 A1 1/2016 Burnett et al.
2016/0236046 A1 8/2016 Girard et al.
2016/0299570 A1 * 10/2016 Davydov ..... G06F 3/167
2016/0317896 A1 * 11/2016 Albelo ..... G01S 19/19
2017/0232313 A1 8/2017 Guerrette et al.
2018/0185719 A1 7/2018 Johnson et al.
2018/0345099 A1 12/2018 Harbert et al.
2019/0009145 A1 1/2019 Guerrette et al.
2019/0111326 A1 4/2019 Girard et al.
2019/0184246 A1 6/2019 Harbert et al.
2019/0336834 A1 7/2019 Greaney et al.
2019/0232120 A1 8/2019 Johnson et al.
2021/0001189 A1 1/2021 Johnson et al.
2021/0146203 A1 2/2021 Greaney et al.
2021/0060392 A1 3/2021 Greaney et al.
2021/0069559 A1 3/2021 Albertsen et al.
2021/0113896 A1 4/2021 Greensmith et al.
2021/0138323 A1 5/2021 Harbert et al.
2021/0170248 A1 6/2021 Girard et al.

(56) References Cited

U.S. PATENT DOCUMENTS

| | | | |
|---|---|---|---|
| 2021/0213334 | A1 | 7/2021 | Honea et al. |
| 2022/0176211 | A1 | 6/2022 | Greaney et al. |
| 2022/0212067 | A1 | 7/2022 | Greaney et al. |

OTHER PUBLICATIONS

U.S. Appl. No. 11/219,803, filed Jan. 11, 2022, Greaney et al.

* cited by examiner

GOLF CLUB

REFERENCE TO RELATED APPLICATIONS

This application is a continuation of and claims priority to U.S. patent application Ser. No. 16/046,106, filed Jul. 26, 2018, which is a continuation of and claims priority to U.S. patent application Ser. No. 15/197,551, filed Jun. 29, 2016, now U.S. Pat. No. 10,052,530, which claims benefit of priority under 35 U.S.C. § 119(e) to Provisional Application No. 62/185,882 entitled "GOLF CLUB" filed Jun. 29, 2015, both of which are incorporated by reference herein in their entirety. This application references U.S. Pat. No. 8,771,095 to Beach, et. al, entitled "CONTRAST-ENHANCED GOLF CLUB HEADS," filed Mar. 18, 2011.

TECHNICAL FIELD

This disclosure relates to golf clubs. More specifically, this disclosure relates to golf club alignment.

SUMMARY

Aspects of the invention are directed to golf club heads including a body having a face, a crown and a sole together defining an interior cavity, the golf club body including a heel and a toe portion and having x, y and z axes which are orthogonal to each other having their origin at USGA center face and wherein the golf club head has a primary alignment feature comprising a paint or masking line which delineates the transition between at least a first portion of the crown having an area of contrasting shade or color with the shade or color of the face.

In some embodiments the golf club head includes a body having a face, a sole and a crown, the crown having a first portion having a first color or shade and a second portion having a second color or shade, the face crown and sole together defining an interior cavity, the golf club body including a heel and a toe portion and having x, y and z axes which are orthogonal to each other having their origin at USGA center face and wherein the golf club head has a primary alignment feature comprising a paint or masking line which delineates the transition between at least a first portion of the crown having an area of contrasting shade or color and the area of shade or color of the face, and the club head also includes a secondary alignment feature including a paint or masking line which delineates the transition between the first portion of the crown having an area of contrasting shade or color with the shade or color of the face; and a second portion of the crown having an area of contrasting shade or color with the shade or color of the first portion, the secondary alignment feature comprising a first elongate side having a length of from about 0.5 inches to about 1.7 inches, and a second and third elongate side extending back from the face and rearward from and at an angle to the first elongate side.

In some embodiments the golf club heads have a body having a face, a crown and a sole together defining an interior cavity, the golf club body also includes a heel and a toe portion and a portion of the crown comprises an electronic display, wherein the electronic display includes an organic light-emitting diode (OLED) display for providing active color and wherein the OLED display is divided into independently operating electronic display zones.

In some embodiments the golf club heads have a body having a face, a crown and a sole together defining an interior cavity, the golf club body also includes a heel and a toe portion and a portion of the crown or a layer covering at least a portion of the crown of the golf club head is covered by a dielectric coating system.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Figure 1B:
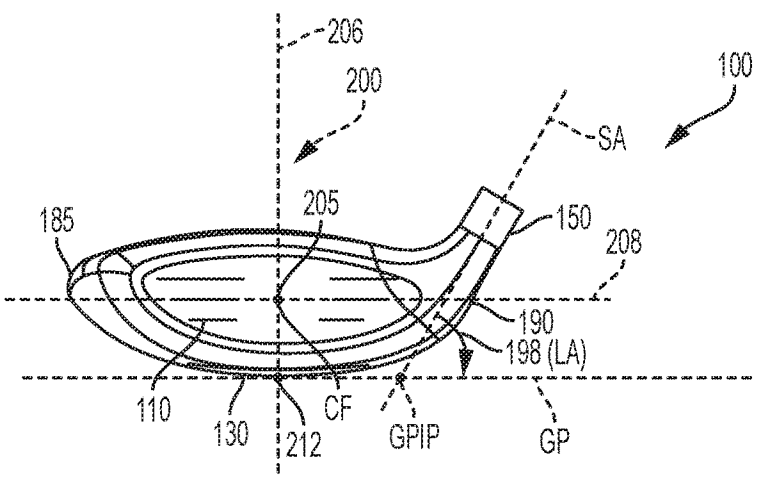
FIG. 1B is a face side view of the golf club head of FIG. 1A.

Disclosed are various golf clubs as well as golf club heads including alignment features along with associated methods, systems, devices, and various apparatus. It would be understood by one of skill in the art that the disclosed golf clubs and golf club heads are described in but a few exemplary embodiments among many. No particular terminology or description should be considered limiting on the disclosure or the scope of any claims issuing therefrom.

The sport of golf is fraught with many challenges. Enjoyment of the game is increased by addressing the need to hit the golf ball further, straighter, and with more skill. As one progresses in golfing ability, the ability to compete at golf becomes a source of enjoyment. However, one does not simply hit a golf ball straighter or further by mere desire. Like most things, skill is increased with practice—be it repetition or instruction—so that certain elements of the game become easier over time. But it may also be possible to improve one's level of play through technology.

Much technological progress in the past several decades of golf club design has emphasized the ability to hit the golf ball further. Some of these developments include increased coefficient of restitution (COR), larger golf club heads, lighter golf club heads, graphite shafts for faster club speed, and center of gravity manipulation to improve spin characteristics, among others. Other developments have addressed a golfer's variability from shot-to-shot, including larger golf club heads, higher moment of inertia (MOI), variable face thickness to increase COR for off-center shots, and more. Still further developments address a golfer's consistent miss-hits—of which the most common miss-hit is a slice—including flight control technology (FCT, such as loft and lie connection sleeves to adjust, inter alia, face angle), moveable weights, sliding weight technologies, and adjustable sole pieces (ASP). Such technologies aid golfers in fixing a consistent miss, such that a particular error can be addressed.

As such, modern technology has done much to improve the golfer's experience and to tailor the golf club to the needs of the particular player. However, some methods are more effective than others at achieving the desired playing results. For example, research suggests that—for a drive of about 280 yards—a 1° difference in face angle at impact may account for about 16 yards of lateral dispersion in the resultant shot. Similarly, for moveable weights, changes in balance of weight by 12 grams moving for about 50 mm may result in about 15 yards of lateral dispersion on the resultant shot. However, it is also understood that a change in lie angle of the golf club head affects the face angle, but at a much smaller degree. As such, simply by increasing lie angle by 1°, the face angle alignment of the golf club head may be adjusted by 0.1° open or closed. As such, for better players who are simply trying to tune their ball flight, adjusting lie angle may be much more finely tunable than adjusting face angle. However, for many golfers, slicing (a rightward-curving shot for a right-handed golfer, as understood in the art) is the primary miss, and correction of such shot is paramount to enjoyment of the game.

One of the major challenges in the game of golf involves the difference between perception and reality. Golf includes psychological challenges—as the player's confidence wanes, his or her ability to perform particular shots often wanes as well. Similarly, a player's perception of his or her own swing or game may be drastically different from the reality. Some technology may address the player's perception and help aid in understanding the misconceptions. For example, technology disclosed in U.S. Pat. No. 8,771,095 to Beach, et. al, entitled "CONTRAST-ENHANCED GOLF CLUB HEADS," filed Mar. 18, 2011, provides a player with a clearer understanding of his or her alignment than some of the preexisting art at the time, which may improve that player's ability to repeat his or her shots. However, it may be more helpful to provide those players a method to address the misconceptions and provide correction for them.

We have now surprisingly found that alignment features that includes all or a portion of the interface region between the areas of contrasting shade or color on the crown of the club head and the face of the club head and/or all or a portion of the interface region between areas of contrasting shade or color on different portions on the crown of the club head allows for improved performance in the resulting clubs by accounting for not only the actual alignment of the club head by the golfer during the shot but also as modified by the perceived alignment of the club head by the golfer. One example of a combination of contrasting colors or shades would be for example a black or metallic grey or silver color contrasting with white, but also included are other combinations which provide at a minimum a "just noticeable difference" to the human eye.

Figure 11:
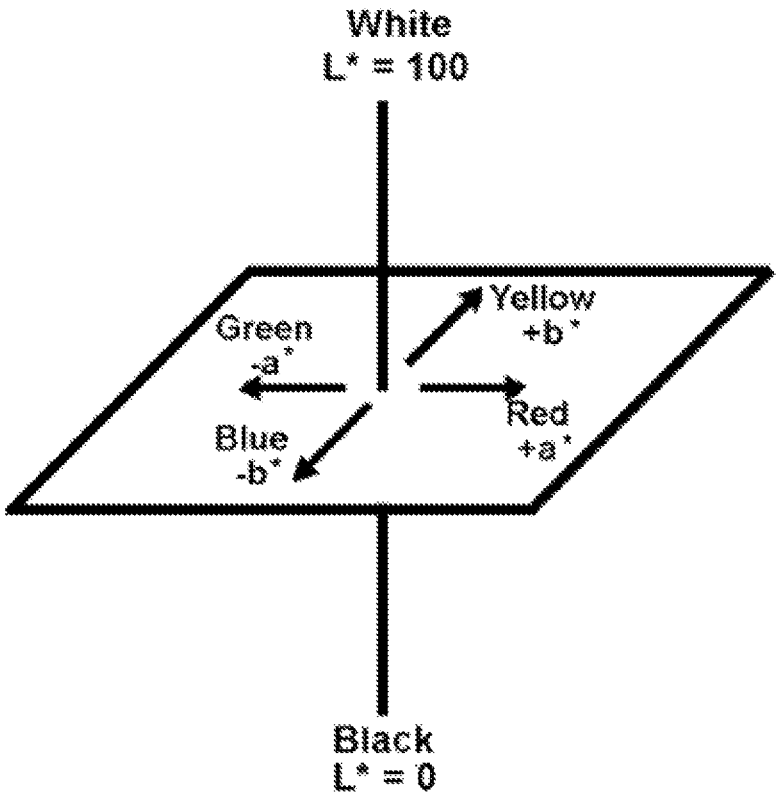
FIG. 11 is a reference to the CIELAB color system.

Although a "just noticeable difference" in terms of colors of a golf club head is to a degree somewhat subjective based on an individual's visual acuity, it can be quantified with reference to the CIELAB color system, a three dimensional system which defines a color space with respect to three channels or scales, one scale or axis for Luminance (lightness) (L) an "a" axis which extends from green (−a) to red (+a) and a "b" axis from blue (−b) to yellow (+b). This three dimensional axis is illustrated in FIG. 11.

A color difference between two colors can then be quantified using the following formula;

$$\Delta E^*_{ab}=\sqrt{(L^*_2-L^*_1)^2+(a^*_2-a^*_1)^2+(b^*_2-b^*_1)^2}$$

where ($L^*_1$, $a^*_1$ and $b^*_1$) and ($L^*_2$, $a^*_2$ and $b^*_2$) represents two colors in the L,a,b space and where $\Delta E^*_{ab}=2.3$ sets the threshold for the "just noticeable difference" under illuminant conditions using the reference illuminant D65 (similar to outside day lighting) as described in CIE 15.2-1986.

Thus, for the alignment features of the golf clubs of the present invention, a contrasting color difference, $\Delta E^*_{ab}$, is greater than 2.3, preferably greater than 10, more preferably greater than 20, even more preferably greater than 40 and even more preferably greater than 60.

Figure 1D:
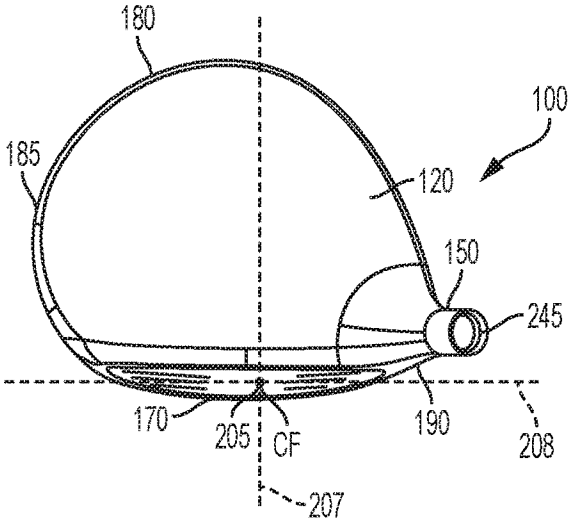
FIG. 1D is a top view of the golf club head of FIG. 1A.
Figure 1A:
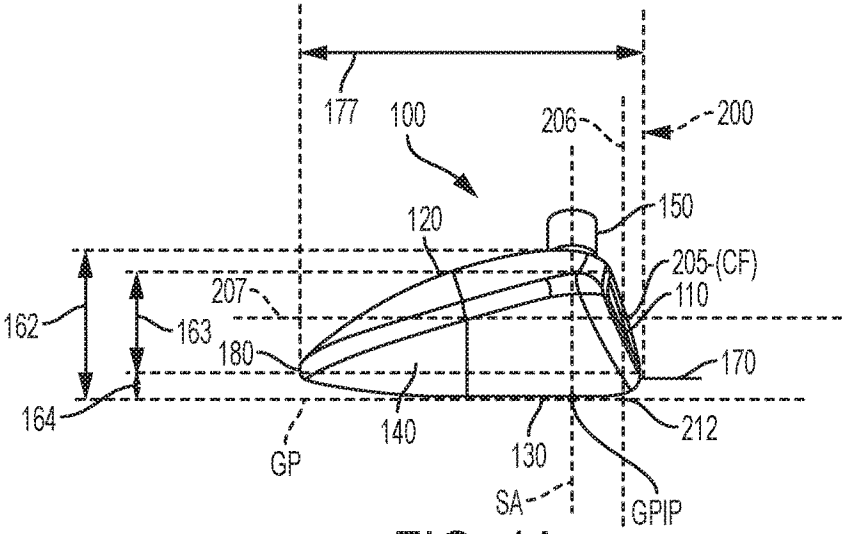
FIG. 1A is a toe side view of a golf club head in accord with one embodiment of the current disclosure.
Figure 1C:
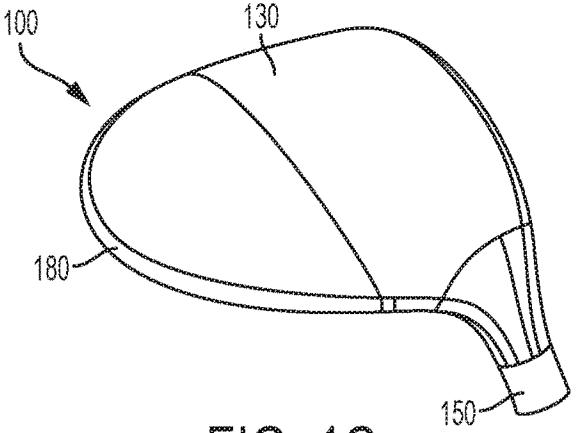
FIG. 1C is perspective view of the golf club head of FIG. 1A.

For general reference, a golf club head 100 is seen with reference to FIGS. 1A-1D. One embodiment of a golf club head 100 is disclosed and described with reference to FIGS. 1A-1D. As seen in FIG. 1A, the golf club head 100 includes a face 110, a crown 120, a sole 130, a skirt 140, and a hosel 150. Major portions of the golf club head 100 not including the face 110 are considered to be the golf club body for the purposes of this disclosure.

The metal wood club head 100 has a volume, typically measured in cubic-centimeters ($cm^3$), equal to the volumetric displacement of the club head 100, assuming any apertures are sealed by a substantially planar surface. (See United States Golf Association "Procedure for Measuring the Club Head Size of Wood Clubs," Revision 1.0, Nov. 21, 2003). In other words, for a golf club head with one or more weight ports within the head, it is assumed that the weight ports are either not present or are "covered" by regular, imaginary surfaces, such that the club head volume is not affected by the presence or absence of ports. In several embodiments, a golf club head of the present application can be configured to have a head volume between about 110 $cm^3$ and about 600 $cm^3$. In more particular embodiments, the head volume is between about 250 $cm^3$ and about 500 $cm^3$. In yet more specific embodiments, the head volume is between about 300 $cm^3$ and about 500 $cm^3$, between 300 $cm^3$ and about 360 $cm^3$, between about 360 $cm^3$ and about 420 $cm^3$ or between about 420 $cm^3$ and about 500 $cm^3$.

In the case of a driver, the golf club head has a volume between approximately 300 $cm^3$ and approximately 460 $cm^3$, and a total mass between approximately 145 g and approximately 245 g. In the case of a fairway wood, the golf club head 10 has a volume between approximately 100 $cm^3$ and approximately 250 $cm^3$, and a total mass between approximately 145 g and approximately 260 g. In the case of a utility or hybrid club the golf club head 10 has a volume between approximately 60 $cm^3$ and approximately 150 $cm^3$, and a total mass between approximately 145 g and approximately 280 g.

A three dimensional reference coordinate system 200 is shown. An origin 205 of the coordinate system 200 is located at the center of the face (CF) of the golf club head 100. See U.S.G.A. "Procedure for Measuring the Flexibility of a Golf Clubhead," Revision 2.0, Mar. 25, 2005, for the methodology to measure the center of the striking face of a golf club. The coordinate system 200 includes a z-axis 206, a y-axis 207, and an x-axis 208 (shown in FIG. 1B). Each axis 206,207,208 is orthogonal to each other axis 206,207, 208. The x-axis 208 is tangential to the face 110 and parallel to a ground plane (GP). The golf club head 100 includes a leading edge 170 and a trailing edge 180. For the purposes of this disclosure, the leading edge 170 is defined by a curve, the curve being defined by a series of forward most points, each forward most point being defined as the point on the golf club head 100 that is most forward as measured parallel to the y-axis 207 for any cross-section taken parallel to the plane formed by the y-axis 207 and the z-axis 206. The face 110 may include grooves or score lines in various embodiments. In various embodiments, the leading edge 170 may also be the edge at which the curvature of the particular section of the golf club head departs substantially from the roll and bulge radii.

As seen with reference to FIG. 1B, the x-axis 208 is parallel to the GP onto which the golf club head 100 may be properly soled—arranged so that the sole 130 is in contact with the GP in the desired arrangement of the golf club head 100. The y-axis 207 is also parallel to the GP and is orthogonal to the x-axis 208. The z-axis 206 is orthogonal to the x-axis 208, the y-axis 207, and the GP. The golf club head 100 includes a toe 185 and a heel 190. The golf club head 100 includes a shaft axis (SA) defined along an axis of the hosel 150. When assembled as a golf club, the golf club head 100 is connected to a golf club shaft (not shown). Typically, the golf club shaft is inserted into a shaft bore 245 defined in the hosel 150. As such, the arrangement of the SA with respect to the golf club head 100 can define how the golf club head 100 is used. The SA is aligned at an angle 198 with respect to the GP. The angle 198 is known in the art as the lie angle (LA) of the golf club head 100. A ground plane intersection point (GPIP) of the SA and the GP is shown for reference. In various embodiments, the GPIP may be used as a point of reference from which features of the golf club head 100 may be measured or referenced. As shown with reference to FIG. 1A, the SA is located away from the origin 205 such that the SA does not directly intersect the origin or any of the axes 206,207,208 in the current embodiment. In various embodiments, the SA may be arranged to intersect at least one axis 206,207,208 and/or the origin 205. A z-axis ground plane intersection point 212 can be seen as the point that the z-axis intersects the GP. The top view seen in FIG. 1D shows another view of the golf club head 100. The shaft bore 245 can be seen defined in the hosel 150.

Referring back to FIG. 1A, a crown height 162 is shown and measured as the height from the GP to the highest point of the crown 120 as measured parallel to the z-axis 206. The golf club head 100 also has an effective face height 163 that is a height of the face 110 as measured parallel to the z-axis 206. The effective face height 163 measures from a highest point on the face 110 to a lowest point on the face 110 proximate the leading edge 170. A transition exists between the crown 120 and the face 110 such that the highest point on the face 110 may be slightly variant from one embodiment to another. In the current embodiment, the highest point on the face 110 and the lowest point on the face 110 are points at which the curvature of the face 110 deviates substantially from a roll radius. In some embodiments, the deviation characterizing such point may be a 10% change in the radius of curvature. In various embodiments, the effective face height 163 may be 2-7 mm less than the crown height 162. In various embodiments, the effective face height 163 may be 2-12 mm less than the crown height 162. An effective face position height 164 is a height from the GP to the lowest point on the face 110 as measured in the direction of the z-axis 206. In various embodiments, the effective face position height 164 may be 2-6 mm. In various embodiments, the effect face position height 164 may be 0-10 mm. A distance 177 of the golf club head 100 as measured in the direction of the y-axis 207 is seen as well with reference to FIG. 1A. The distance 177 is a measurement of the length from the leading edge 170 to the trailing edge 180. The distance 177 may be dependent on the loft of the golf club head in various embodiments.

For the sake of the disclosure, portions and references disclosed above will remain consistent through the various embodiments of the disclosure unless modified. One of skill in the art would understand that references pertaining to one embodiment may be included with the various other embodiments.

Figure 2:
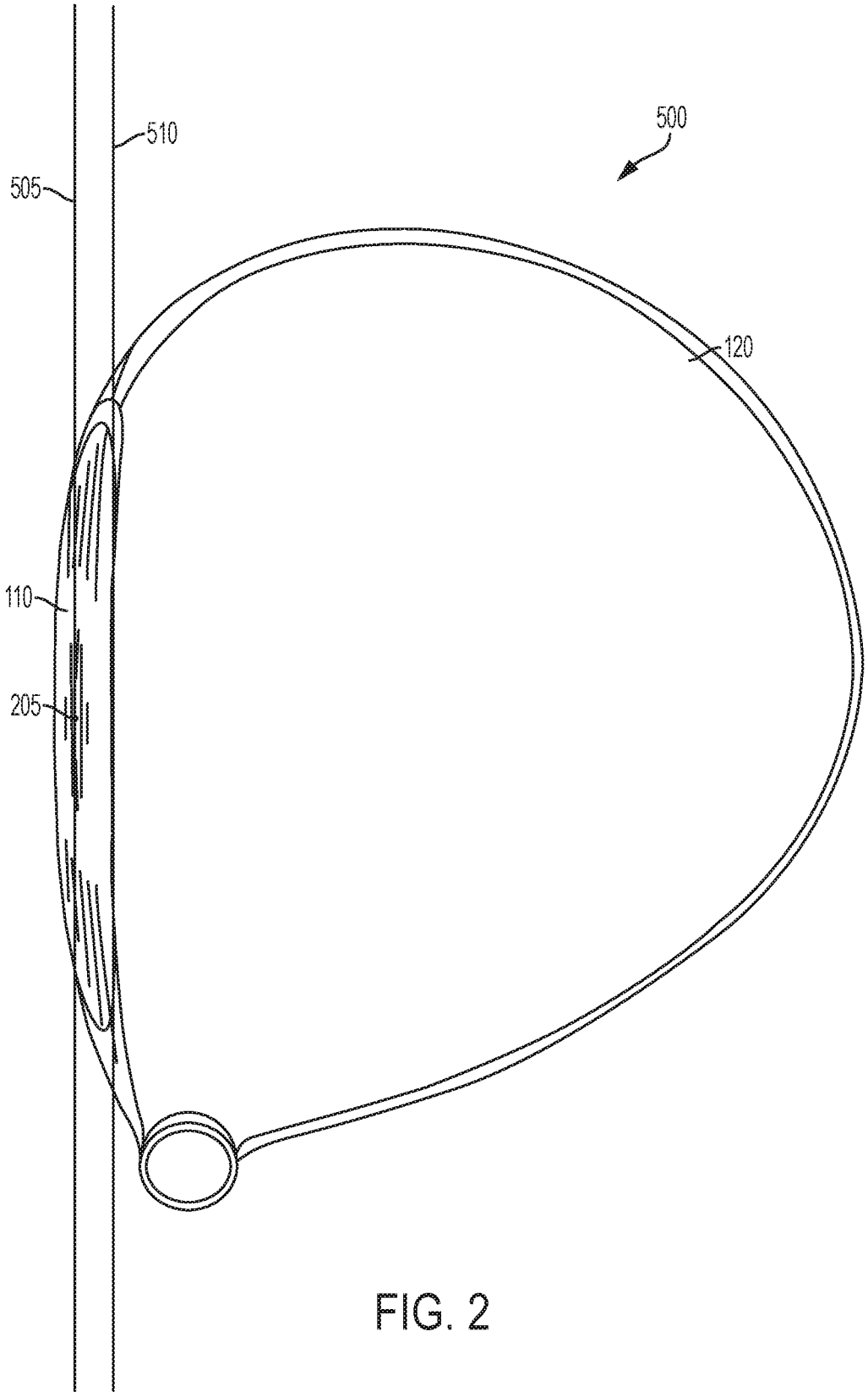
FIG. 2 is a top view of a golf club head in accord with one embodiment of the current disclosure.

As seen with reference to FIG. 2, a golf club head 500 includes a painted crown 120 and unpainted face 110. Painted or otherwise contrast-enabled crowns have been utilized as described in U.S. Pat. No. 8,771,095 to Beach, et. al, entitled "CONTRAST-ENHANCED GOLF CLUB HEADS," filed Mar. 18, 2011, to provide golfers with aided alignment. Typically the golfer employs the crown to face transition or top-line to align the club with the desired direction of the target line. The top-line transition is clearly delineated by a masking line between the painted crown and the unpainted face. While such features may have been described to some degree, use of the features to bias alignment has not been conceived in the art. With the golf club head 500 of the current embodiment, one of skill in the art would understand that the high-contrast described in U.S. Pat. No. 8,771,095 to Beach, et. al, entitled "CONTRAST-ENHANCED GOLF CLUB HEADS," filed Mar. 18, 2011, may be beneficial for emphasizing various alignment features. As such, the disclosure is incorporated by reference herein in its entirety.

For reference, a face angle tangent 505 is seen in FIG. 2. The face angle tangent 505 indicates a tangent line to the center face 205. The face angle tangent 505 in the current embodiment is coincident with the x-axis 206 (as seen with reference to prior FIGS.). Also seen in FIG. 2 is a top tangent 510. In the current embodiment, the top tangent 510 is a line made tangent to a top of the face 110 because, in the current embodiment, a joint between the face 110 and the crown 120 is coincident with paint lines. The top tangent 510 in the several embodiments of the current disclosure will follow the contours of various paint lines of the crown 120, and one of skill in the art would understand that the top tangent 510 need not necessarily be coincident with a tangent to the face 110. However, in the current embodiment, the top tangent 510 is parallel to the face angle tangent 505. As such, the paint of the crown 120 can be described as appearing square with the face angle.

The purpose of highlighting such features of the golf club head 500 is to provide a basis for the discussion of alignment with respect to the current disclosure. Through variations in alignment patterns, it may be possible to influence the golfer such that the golfer alters his or her play because of the appearance of misalignment. If a player perceives that the golf club head is such that the face is open with reference to the intended target, he or she would be more likely to try to "square up" the face by manually closing it. Many golfers prefer not to perceive a metal wood golf club head as appearing closed, as such an appearance is difficult to correct. However, even if such a player were to perceive the metal wood head as being closed, such perception does not mean that the golf club head is aligned in a closed position relative to the intended target.

Figure 3:
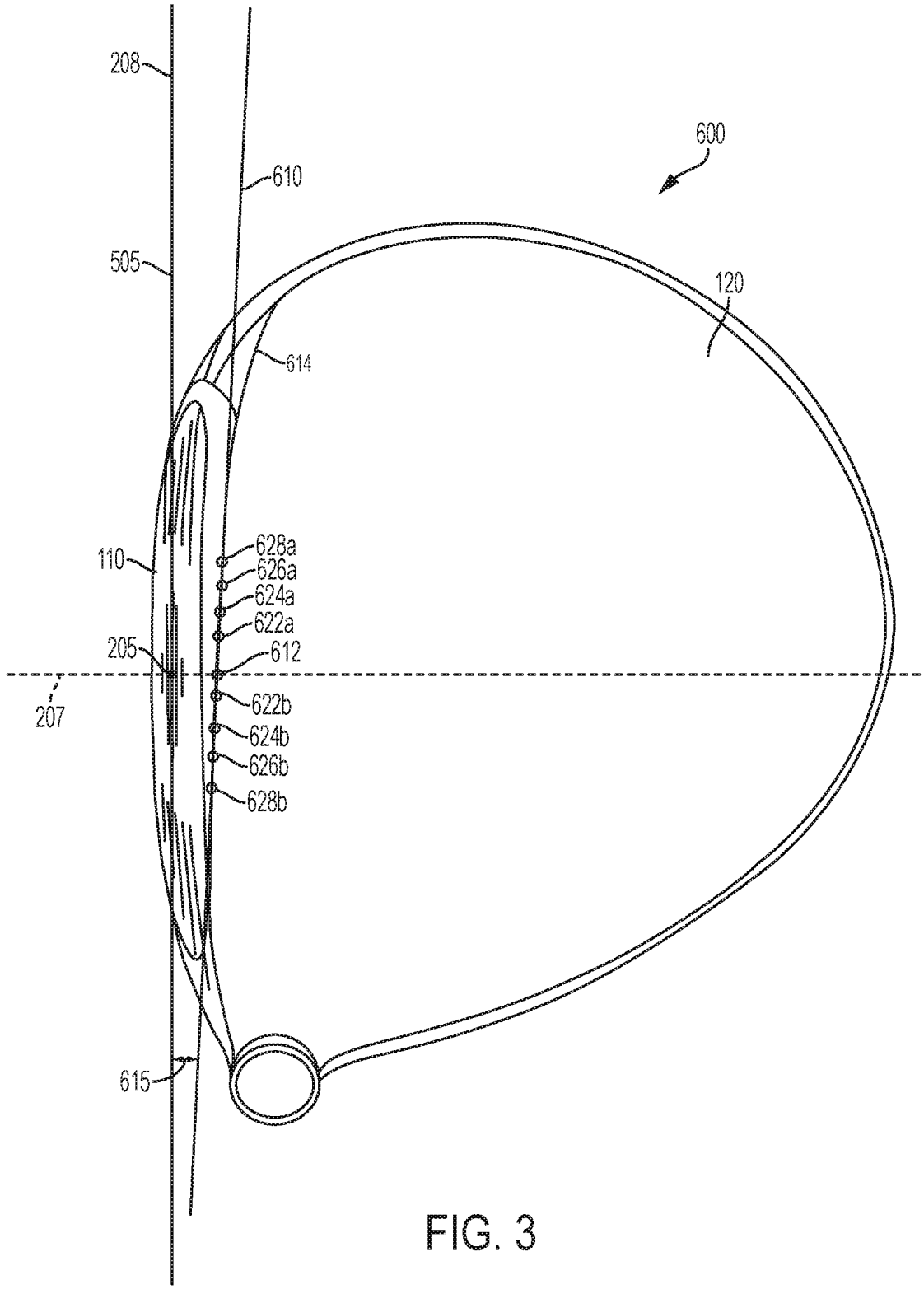
FIG. 3 is a top view of a golf club head in accord with one embodiment of the current disclosure.

As seen with reference to FIG. 3, a golf club head 600 includes similar head geometries to golf club head 500. However, the golf club head 600 includes a feature to alter the perceived angle of the face 110 for the user. In the current embodiment, a top tangent 610 that is aligned at an angle 615 with respect to the face angle tangent 505 such that the perceived angle of the face (Perceived Face Angle, PFA) is different from the actual alignment of the face angle tangent 505. In the current embodiment, the angle 615 is about 4°. In various embodiments, the angle 615 may be 2°-6°. In various embodiments, the angle 615 may be less than 7°. In various embodiments, the angle 615 may be 5-10°. In various embodiments, the angle 615 may be less than 12°. In various embodiments, the angle 615 may be up to 15°. As indicated with respect to top tangent 510, the top tangent 610 is an indicator of the alignment of an edge of an area of contrasting paint or shading of the crown 120 delineated by a masking line between the painted crown and the unpainted face relative to the color or shading of the face 110 and is the line that is tangent to an edge 614 of the contrasting crown paint or crown shading at a point 612 where the edge 614 intersects a line parallel to the y-axis 207.

In various embodiments, a perceived angle may be determined by finding a linear best-fit line of various points. For such approximation, a perceived angle tangent may be determined by best fitting points on the edge 614 at coordinates of the x-axis 208 that are coincident with center face 205—point 612—and at points ±5 mm of CF 205 (points 622*a,b*), at points ±10 mm of CF 205 (points 624*a,b*), at points ±15 mm of CF 205 (points 626*a,b*), and at points ±20 mm of CF 205 (points 628*a,b*). As such, nine points are defined along the edge 614 for best fit of the top tangent 610. In the current embodiment, the perceived angle tangent is the same as the top tangent 610.

However, such method for determining the perceived angle tangent may be most useful in cases where the edge 614 of an area of contrasting paint or shading of the crown 120 relative to the color or shading of the face 110 includes different radii of relief along the toe portion and the heel portion. In such an embodiment, a line that is tangent to the edge 614 at point 612 may not adequately represent the appearance of the alignment of the golf club head 600. Such an example can be seen with reference to FIG. 4.

Figure 4:
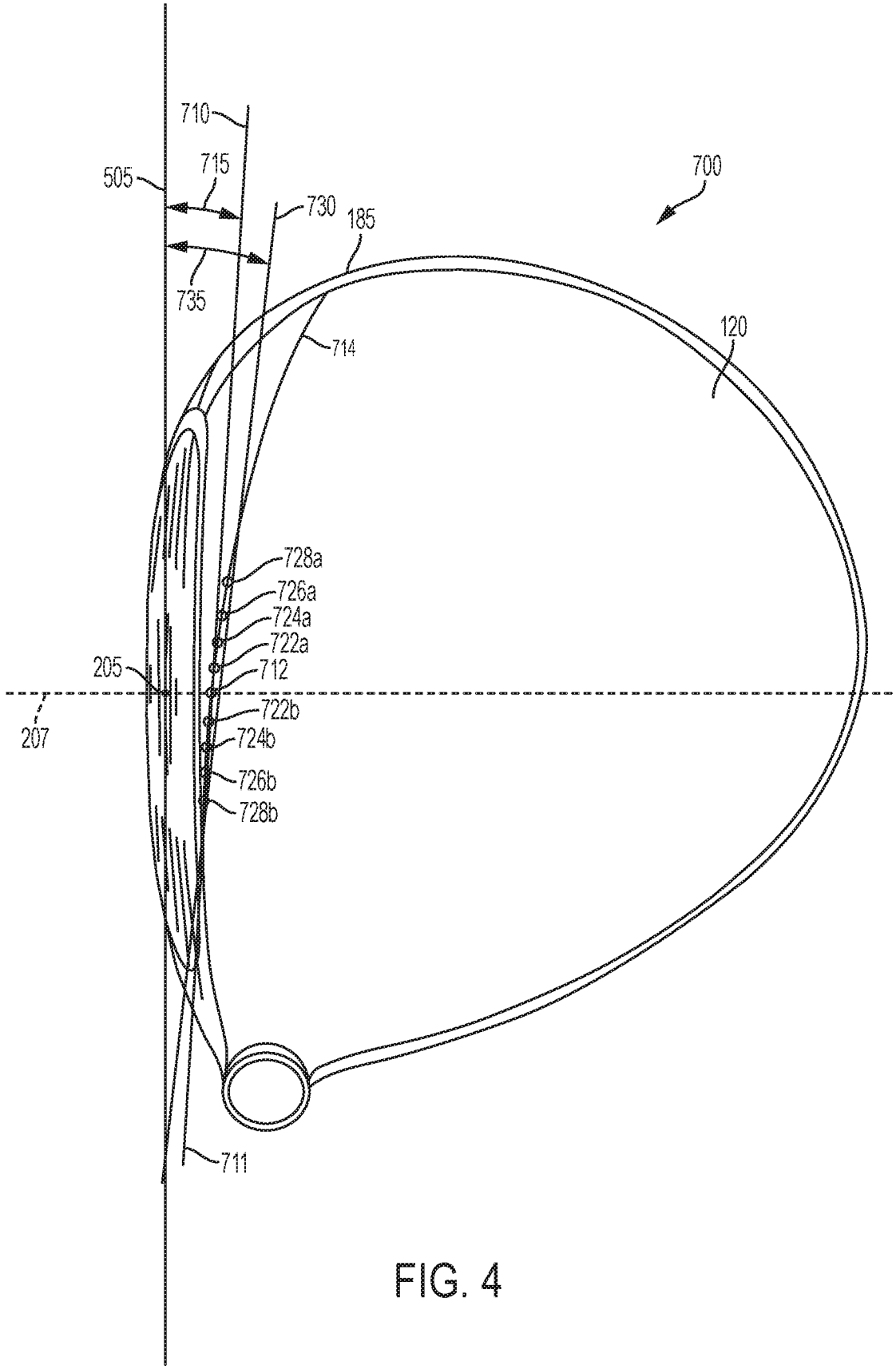
FIG. 4 is a top view of a golf club head in accord with one embodiment of the current disclosure.

As seen in FIG. 4, a golf club head 700 includes an edge 714 of an area of contrasting paint or shading of the crown 120 relative to the color or shading of the face 110 that is more aggressively rounded proximate the toe 185 than prior embodiments. As such, a line 711 that is literally tangent to the edge 714 at a point 712 that is coincident with the y-axis 207 may not adequately describe the perception. Such a line would be the top tangent 710. However as noted previously with reference to golf club head 600, points 712, 722*a,b*, 724*a,b*, 726*a,b*, and 728*a,b*, can be used to form a best fit line 730 that is aligned at a perceived angle 735 that is greater than an angle 715 of the top tangent 710. In various embodiments, the perceived angle 735 may be within the increments of angle 615, above, or may be up to 20° in various embodiments. In most embodiments, the perceived angle 735 may be 8-10°. In various embodiments, the perceived angle 735 may be 9-10°. In various embodiments, the perceived angle 735 may be 7-11°. In various embodiments, the perceived angle 735 may be 7-8.5°. In various embodiments, alignment may be influenced by the inclusion of an alignment feature that does not invoke an edge such as edges 614, 714. As seen with reference to FIG. 5, various embodiments of alignment features may be suggestive of the face angle and, as such, provide an appearance of alignment to the golfer without modifying paint lines.

Figure 5:
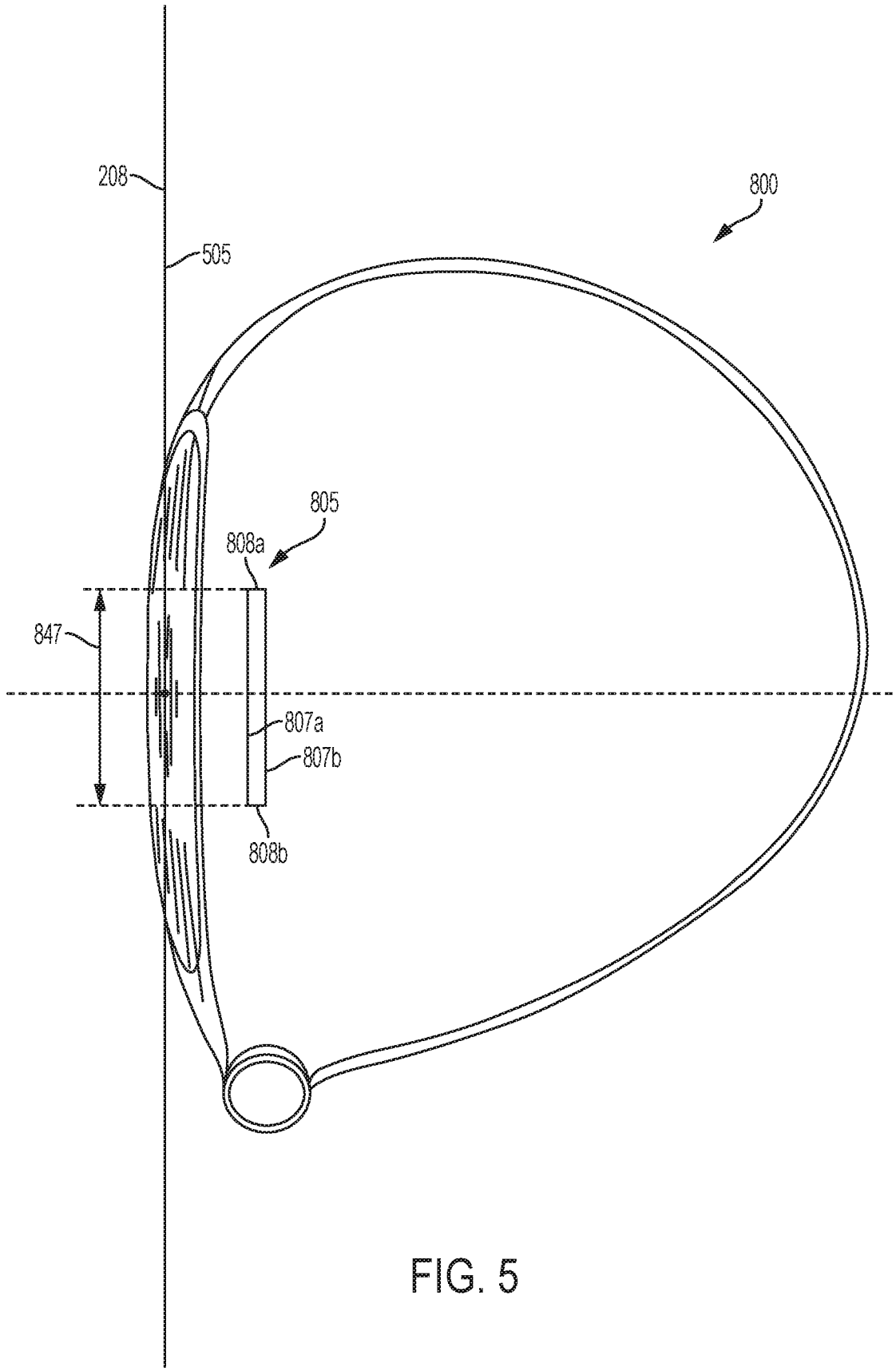
FIG. 5 is a top view of a golf club head in accord with one embodiment of the current disclosure.

A golf club head 800, as seen in FIG. 5, includes an alignment feature 805. The alignment feature 805 of the current embodiment includes at least one elongate side 807—and in the current embodiment, two elongate sides 807*a* and 807*b* are included. The alignment feature 805 of the current embodiment also includes two additional sides 808*a* and 808*b*. As can be seen, the alignment feature 805 is arranged such that the at least one elongate side 807 is aligned about parallel to the x-axis. As such, a golfer is able to use the alignment feature 805 by aligning the direction of the elongate side 807 in an orientation that is about perpendicular to the intended target. The alignment feature 805 has a length 847 as measured parallel to the x-axis 208. In the current embodiment, the length 847 is about the same as the diameter of a golf ball, or about 1.7 inches. However, in various embodiments, the length 847 may be 0.5 inches, 0.75 inches, 1 inch, 1.25 inches, 1.5 inches, 1.75 inches, 2 inches, 2.25 inches, 2.5 inches, or various lengths therein. If the length 847 of the dominant elongate side 807*a* or 807*b* is less than about 0.3 inches, the impact of the alignment feature 805 on biasing the golfer's perception decreases substantially.

However, with sufficient use, the alignment feature 805 can become the primary focus of the golfer's attention and, as such, modifications to the arrangement of the alignment feature 805 with respect to the x-axis 208 (which is coincident with the face angle tangent 505) may allow the golfer to bias his or her shots and thereby modify his or her outcome.

Figure 6:
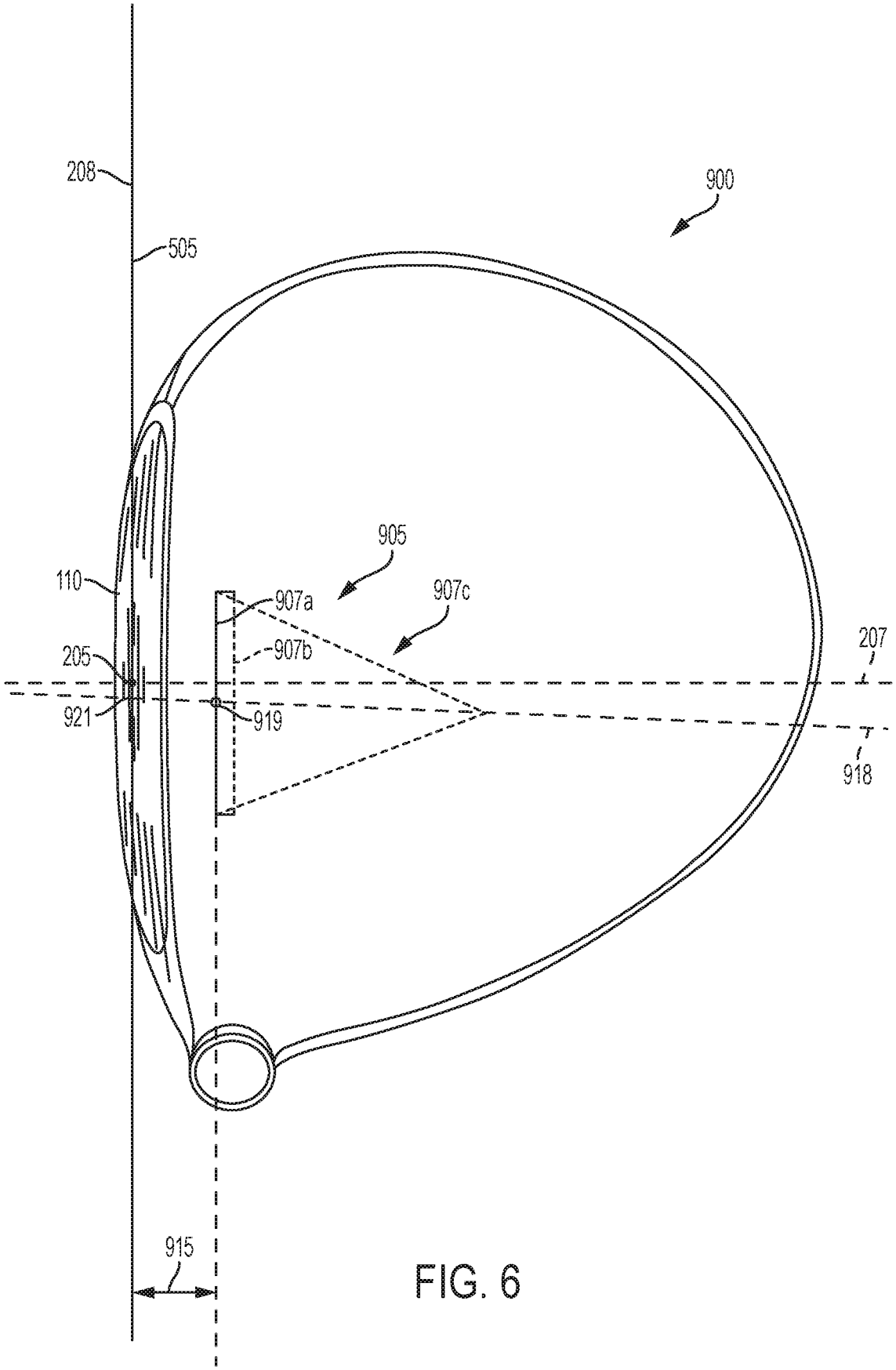
FIG. 6 is a top view of a golf club head in accord with one embodiment of the current disclosure.

As seen with reference to FIG. 6, a golf club head 900 includes an alignment feature 905. The alignment feature 905 of the current embodiment includes one elongate side 907*a* on a side of the alignment feature 905 that is proximate the face 110. The alignment feature 905 includes several potential rear portions. Similar to golf club head 800, golf club head 900 includes the alignment feature 905 having a potential second elongate side 907*b* in one embodiment. In another embodiment, an extended rear portion 907*c* may also be included or may be included separately from elongate side 907*b*. In the current embodiment, the elongate side 907*b* is oriented at an angle 915 with respect to the face angle tangent 505.

For the embodiment including second elongate side 907*b*, the second elongate side 907*b* is about parallel to the elongate side 907*a*. As such, the embodiment is similar to golf club head 800 but is oriented at angle 915. With respect to extended rear portion 907*c*, the orientation of such an embodiment may appear less askew and, consequently, may be more effective at modifying the golfer's perception of the club's alignment. A perpendicular reference line 918 is seen as a reference for being orthogonal to the elongate side 907*a*. The perpendicular reference line 918 intersects the elongate side 907*a* at a point 919 that bisects the elongate side 907*a*. Further, the perpendicular reference line 918 intersects the x-axis 208 at an intersection point 921 that is heelward of the center face 205. In the current embodiment, the intersection point 921 is heelward of center face 205 by about 2 mm. In various embodiments, the intersection point 921 may be about the same as center face 205. In various embodiments, the intersection point 921 may be up to 2 mm heelward of center face 205. In various embodiments, the intersection point 921 may be up to 5 mm heelward of center face 205. In various embodiments, the intersection point 921 may be somewhat toeward of center face 205. In various embodiments, the intersection point 921 may be ±2 mm of the center face 205.

Figure 7:
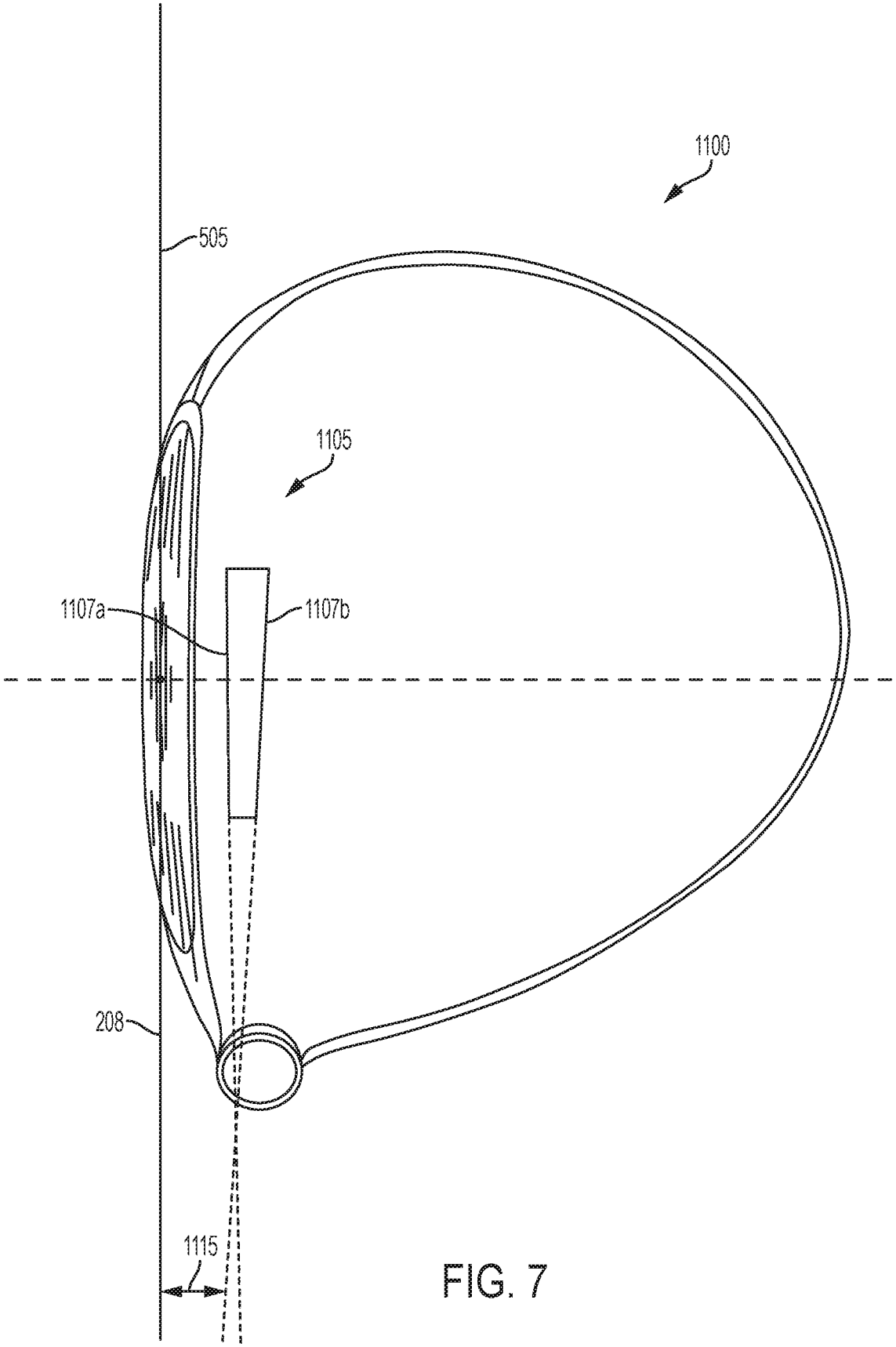
FIG. 7 is a top view of a golf club head in accord with one embodiment of the current disclosure.

Another embodiment of a golf club head 1100, shown in FIG. 7, includes an alignment feature 1105. The alignment feature has a first elongate side 1107*a* and a second elongate side 1107*b*. In the current embodiment, however, the first elongate side 1107*a* is about parallel with the face angle tangent 505 and the x-axis 208. However, the second elongate side 1107*b* is oriented at an angle 1115 with respect to the face angle tangent 505 such that the golfer's perception of alignment may be altered. A preferred method for measuring the perceived face angle observed by a golfer further takes into account the fact that most golfers have a dominant left eye and when they address the ball with the club head, a direct line between the left eye and center face would actually cross the topline heel ward of center face and thus this is where an alignment feature which includes an edge of an area of contrasting paint or shading of the crown 120 relative to the color or shading of the face 110 would exert the most effect on the golfer's perception of the face angle. This perceived face angle is thus called a Sight Adjusted Perceived Face Angle (SAPFA) and is measured using the apparatus shown in FIGS. 8A-8C.

Figure 8B:
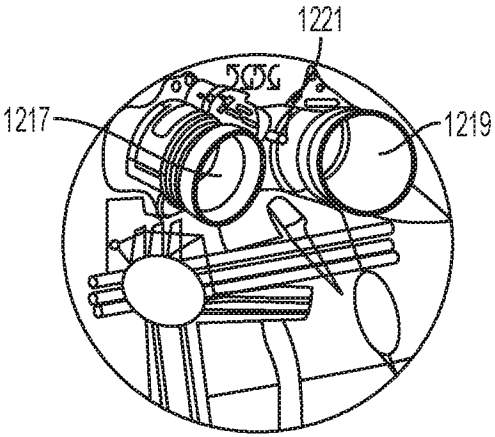
FIG. 8B is a close up view of the arrangement of the laser and cameras in the apparatus used for measuring a Sight Adjusted Perceived Face Angle in accordance with the current disclosure.
Figure 8A:
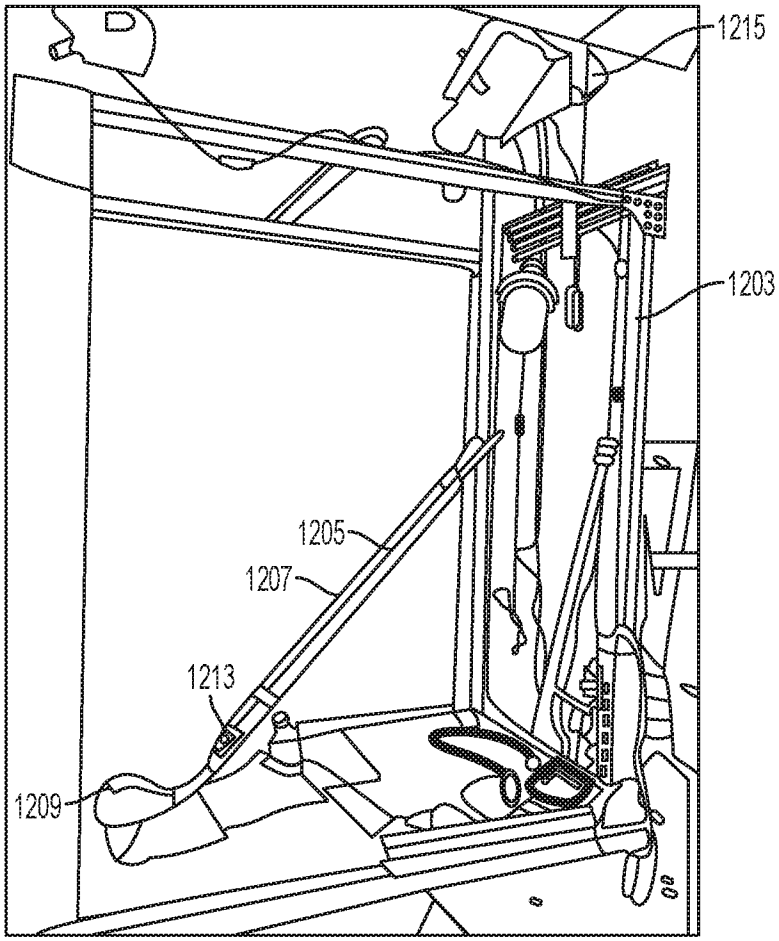
FIG. 8A is a front view of the apparatus used for measuring a Sight Adjusted Perceived Face Angle in accordance with the current disclosure.
Figure 8C:
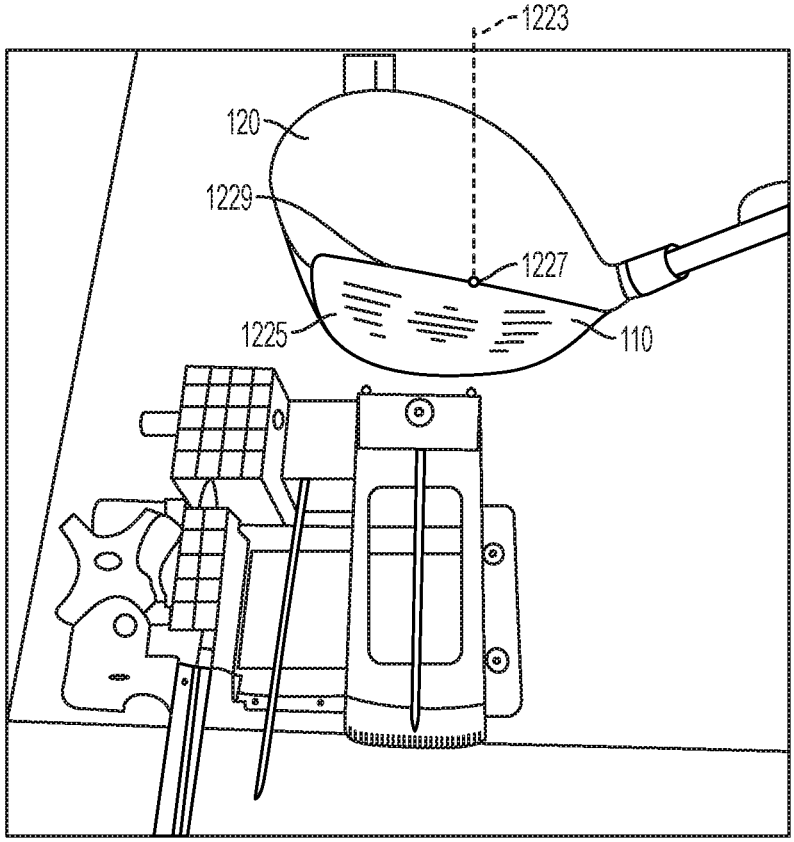
FIG. 8C is a side view of a golf club head fixture in apparatus used for measuring a Sight Adjusted Perceived Face Angle in accordance with the current disclosure.

The apparatus used is shown in FIGS. 8A, 8B and 8C and includes a frame 1203 which holds a fixture 1205 for holding and aligning a golf club shaft 1207 and attached golf club head 1209 at a Lie Angle of 45°. The face of the golf club head 1209 is also set at a face angle of 0° using a face angle gauge 1211. The face angle gauge may be any commonly used in the industry such as a De la Cruz face angle gauge). After setting the loft and lie angle the club is clamped in the fixture using a screw clamp 1213. The frame 1203 also includes an attachment point 1215 for mounting two cameras 1217 and 1219 and a Calpac Laser CP-TIM-230-9-1L-635 (Fine/Precise Red Line Laser Diode Module Class II: 1 mW/635 nm), 1221. The center of the lens of camera 1219 is situated at the x, y and z coordinates (namely 766 mm, 149 mm, 1411 mm) using the previously defined x y and z axes with USGA center face (as measured using the procedure in U.S.G.A. "Procedure for Measuring the Flexibility of a Golf Clubhead," Revision 2.0, Mar. 25, 2005, "USGA Center Face") as the origin, and where a positive x coordinate represents a position heel ward of center face, a positive y coordinate represent a position rearward of center face and a positive z coordinate represents a position above center face. The laser is situated between the two cameras. As shown in FIG. 8C the laser produces a line 1223 having an axis parallel to the camera axis and projecting along the y axis which is adjusted such that the line intersects USGA Center Face 1225. The point 1227 at which the line then intersects the edge of an area of contrasting paint or shading of the crown 120 relative to the color or shading of the face 110 which in this case corresponds to the white paint line of the crown 1229 is then physically marked on the paint line using a marker and acts a the datum or reference point. A camera is then activated to take an image of the club head including the datum or reference point 1227 and the paint line 1229.

The image from the camera is then analyzed using an image analyzer software package (which can be any of these known in the art able to import an image and can fit a line to the image using a curve fitting function). A best fit line to the paint line is then determined. For most embodiments the best fit to the paint line results from fitting the line to a quadratic equation of the form $y=ax^2+bx+c$. Two points are then selected on this best fit line at arc length between +/−0.25 mm from the datum point. A straight line is then drawn between the two points and a line perpendicular to this line is then drawn through the datum. The Sight Adjusted Perceived Face Angle (SAPFA) is then measured as the angle between the perpendicular line and the y axis.

Using this method the Sight Adjusted Perceived Face Angle (SAPFA) of the golf clubs of the present invention may be from −2 to 10, preferably from 0 to 6, more preferably from 0.5 to 4 even more preferably from 1 to 2.5 and most preferably from 1.5 to 2 degrees.

EXAMPLES

Four identical club heads were taken and the paint line edge of an area of contrasting paint or shading of the crown 120 relative to the color or shading of the face 110 was varied and the Sight Adjusted Perceived Face Angles (SAPFA) measured.

In addition to the Sight Adjusted Perceived Face Angles (SAPFA) four additional measurements were taken to describe the paint line edge alignment feature of the four clubs and these values are summarized in Table 1.

In addition to the SAPFA, three additional angles were measured at different points as measured from the datum along the best fit line to the paint line edge alignment feature determined as for the SAPFA. The first angle was obtained at a point along the best fit line at an arc length 25 mm heelward of the datum. Again as for the SAPFA measurement, two points at arc length between +/−0.25 mm from the 25 mm point were selected. A straight line is then drawn between these two points and a line perpendicular to this line is then drawn at the 25 mm point. The angle is then measured between this perpendicular line and the y axis. This angle is reported as the Sight Adjusted Perceived Face Angle 25 mm Heelward ("$SAPFA_{25H}$").

The second angle was obtained at a point along the best fit line at an arc length 25 mm toeward of the datum. Again as for the SAPFA measurement, two points at arc length between +/−0.25 mm from the 25 mm point were selected. A straight line is then drawn between the two points and a line perpendicular to this line is then drawn at the 25 mm point. The angle is then measured between this perpendicular line and the y axis. This angle is reported as the Sight Adjusted Perceived Face Angle 25 mm Toeward ("$SAPFA_{25T}$").

In addition, to capture any effect of greater rounding of the paint line edge alignment feature towards the toe of the golf club head, a third angle was obtained at a point along the best fit line at an arc length 50 mm toeward of the datum. Again as for the SAPFA measurement, two points at arc length between +/−0.25 mm from the 25 mm point were selected. A straight line is then drawn between the two points and a line perpendicular to this line is then drawn at the 50 mm point. The angle is then measured between this perpendicular line and the y axis. This angle is reported as the Sight Adjusted Perceived Face Angle 50 mm Toeward ("SAPFA-SOT").

Finally, in an attempt to describe more of the paint line edge alignment feature, the image of the paint line edge alignment feature imported into the image analyzer as for the SAPFA measurement was also fit to a circle using the formula $(x-a)^2+(y-b)^2=r^2$, and the radius of curvature of this circular fit line determined and reported in Table 1 as the Radius of Curvature (circle fit).

TABLE 1

| Example No. | Sight Adjusted Perceived Face Angle (SAPFA) (degrees) | Radius of Curvature (circle fit, mm) | Angle 25 mm Heelward (degrees) | Angle 25 mm Toeward (degrees) | Angle 50 mm Toeward (degrees) |
|---|---|---|---|---|---|
| 1 | 3.5722 | 570.47 | 1.1377 | 5.9453 | 8.2757 |
| 2 | 5.2813 | 419.53 | 1.7509 | 8.6871 | 11.9168 |
| 3 | 0.2927 | 781.02 | −1.4461 | 2.0189 | 3.7129 |
| 4 | −0.5925 | 568.21 | −3.06 | 1.8533 | 4.245 |

Each club was then hit between 6 to 12 times by 10 different players into a blank screen with no trajectory or other feedback available to the player, and a Trackman 3e launch monitor and the TPS software package were used to calculate the total dispersion from a center target line with a positive total dispersion indicating the number of yards right of the center target line and a negative total dispersion indicating the number of yards left of the center target line. Thus, a player who has a tendency to slice the ball i.e. produce a ball flight right of the target line would be assisted in producing a shot closer to the target line if the golf club tended to yield a more negative dispersion.

Figure 9:
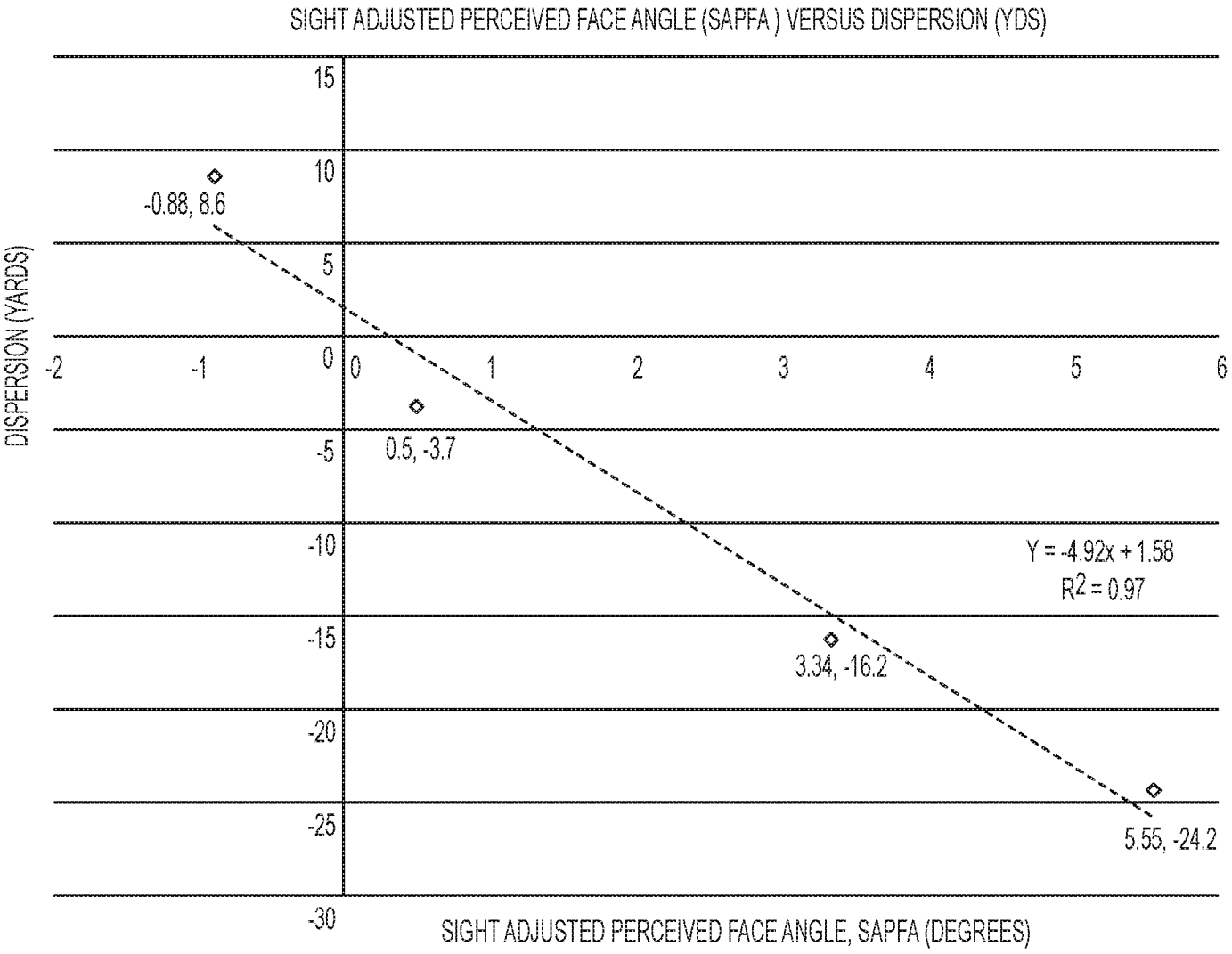
FIG. 9 is a graph of the Sight Adjusted Perceived Face Angle vs. the Dispersion in Ball Flight for four clubs having the alignment features in accordance with the current disclosure.

The graph in FIG. 9 plots the Sight Adjusted Perceived Face Angle (SAPFA) versus the average total dispersion of each club when hit 6-12 times by each player. The data show that adjustment of the edge of an area of contrasting paint or shading of the crown relative to the color or shading of the face such that the Sight Adjusted Perceived Face Angle (SAPFA) of the golf club goes from −0.88 degrees through 0.5 degrees through 3.34 degrees to 5.55 degrees results in an overall change in total dispersion from 8.6 yards to the right of the target line to 24.2 yards to the left of the target i.e. an absolute change in total dispersion of 32.8 yards from the same club head by solely manipulating the appearance of the paint line comprising the primary alignment feature.

The golf club heads of the present invention have a Sight Adjusted Perceived Face Angle (SAPFA) of from about −2 to about 10, preferably of from about 0 to about 6, more preferably of from about 0.5 to about 4 even more preferably of from about 1 to about 2.5 and most preferably of from about 1.5 to about 2 degrees.

The golf club heads of the present invention also have a Sight Adjusted Perceived Face Angle 25 mm Heelward ("$SAPFA_{25H}$") of from about −5 to about 2, more preferably of from about −3 to 0, even more preferably of from about −2 to about −1 degrees.

The golf club heads of the present invention also have a Sight Adjusted Perceived Face Angle 25 mm Toeward ("$SAPFA_{25T}$") of from 0 to about 9, more preferably of from about 1 to about 4.5, even more preferably of from about 2 to about 4 degrees.

The golf club heads of the present invention also have a Sight Adjusted Perceived Face Angle 50 mm Toeward ("$SAPFA_{50T}$") of from about 2 to about 9, more preferably of from about 3.5 to about 8, even more preferably of from about 4 to about 7 degrees.

The golf club heads of the present invention also have a Radius of Curvature (circle fit) of from about 300 to about 1000, more preferably of from about 400 to about 900, even more preferably of from about 500 to about 775 mm.

In other embodiments, the golf club head in addition to having a first or primary alignment feature as described earlier with reference to FIGS. 1-4, may also have a second or secondary alignment feature including the alignment features as described earlier with reference to FIGS. 5, 6 and 7.

Figure 10B:
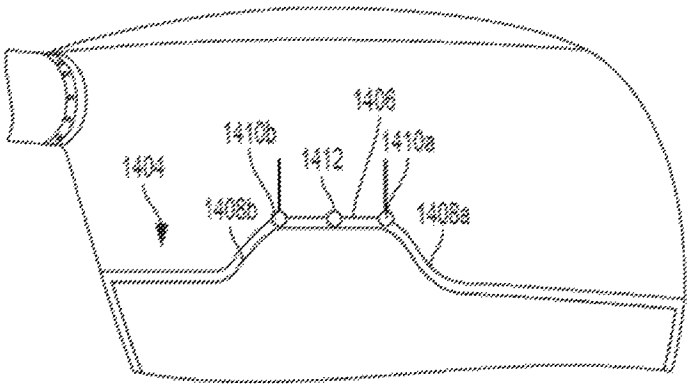
FIG. 10B is a top view of a golf club head in accord with one embodiment of the current disclosure.
Figure 10A:
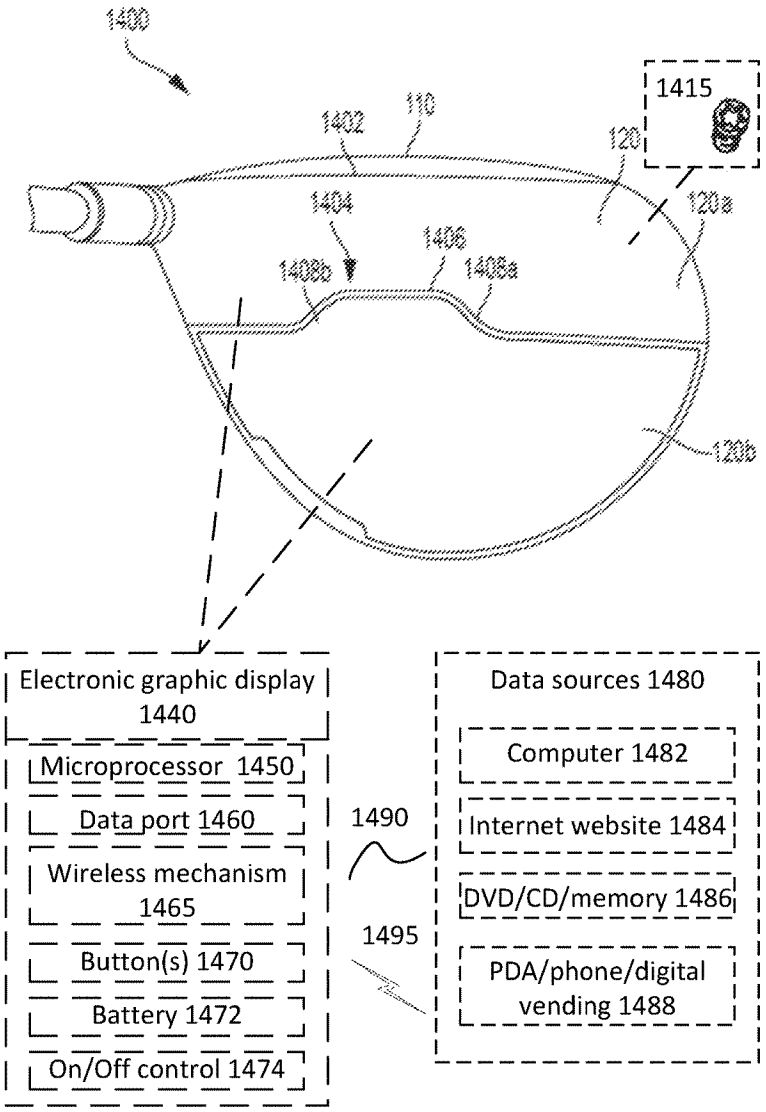
FIG. 10A is a top view of a golf club head in accord with one embodiment of the current disclosure.

In an especially preferred embodiment, shown in FIG. 10A and FIG. 10B, the golf club head 1400 of the present invention can have a crown 120 having a first crown portion 120*a* having a first color or shade and a second crown portion 120*b* having a second color or shade, and a primary alignment feature consisting of a an edge 1402 of an area of contrasting paint or shading of the first crown portion 120*a* relative to the color or shading of the face 110 as described earlier and illustrated, e.g., in FIGS. 3 and 4. In addition, the club head has a secondary alignment feature 1404 proximate the face but rearward of the primary alignment feature and delineated by a second paint or masking line Which delineates the transition between the first crown portion 120*a* having an area, of contrasting shade or color with the shade or color of the face 110; and a second crown portion 120*b* having an area of contrasting shade or color with the shade or color of the first crown portion 120*a*. The secondary alignment feature a comprises an elongate side 1406 having a length of from about 0.5 inches to about 1.7 inches, and a second and third elongate side 1408*a* and 1408*b* extending back from the face and at an angle to elongate side 1406 and rearward of elongate side 1406.

The Sight Adjusted Perceived Face Angle Secondary Alignment Feature, ("$SAPFA_{SAF}$") of the secondary alignment feature constituting elongate side 1406 and the second and third elongate sides 1408*a* and 1408*b* may be measured by importing the image of the club head obtained as per the measurement for the SAPFA. Points 1410*b* and 1410*a* are selected which are the innermost ends of the radii connecting lines 1408*b* and 1408*a* with elongate side 1406 as shown in FIG. 10B. A best fit quadratic line is then fit for the secondary alignment feature between point 1410*a* and 1410*b* and then a datum 1412 is determined as the center point along the arc length of the best fit line, again as for the SAPFA measurement, two points at arc length between +/−0.25 mm from the datum were selected. A straight line is then drawn between these two points and a line perpendicular to this line is then drawn at the datum. The Sight Adjusted Perceived Face Angle Secondary Alignment Feature, ("$SAPFA_{SAF}$") is then measured as the angle between this perpendicular line and the y axis.

In some embodiments, the golf club heads of the present invention also have a Sight Adjusted Perceived Face Angle Secondary Alignment Feature, ("$SAPFA_{SAF}$") of from about −2 to about 6, more preferably of from 0 to about 5, even more preferably of from about 1.5 to about 4 degrees.

The primary and secondary alignment features as described herein typically utilize paint lines which demark the edge of an area of contrasting paint, e.g., between first crown portion 120*a* and second crown portion 120*b*, or shading of the crown 120 relative to the color or shading of the face 110. Preferably the contrasting colors are white in the crown area (e.g., first crown portion 120*a*) and black in the face area. Typically painting or shading of golf club heads is performed at the time of manufacture and thus are fixed for the lifetime of the club absent some additional painting performed after purchase by the owner. It would be highly advantageous if the profile of the alignment features could be adjusted by the user using a simple method which would allow adjustment of the perceived face angle by the user in response to the golfer's observed ball direction tendency on any given day.

In some embodiments of the golf club heads of the present invention the crown 120 comprises a rotatable or otherwise movable portion, e.g., the first crown portion 120*a*, with one side of said portion including the edge of an area of contrasting paint or shading, of the crown 120 relative to the color or shading of the face 110 or relative to the color or shading of the second crown portion 120*b*, which can be rotated or moved sufficient to yield the desired Perceived Face Angle, PFA and/or Sight Adjusted Perceived Face Angle (SAPFA) and/or Sight Adjusted Perceived Face Angle Secondary Alignment Feature, ("$SAPFA_{SAF}$") to produce the desired ball flight. The movable portion of the crown is held in position by a fastening device such as a screw or bolt or other fastening means 1415, which is loosened to allow for rotation or movement and then subsequently tightened to fix the position of the crown after adjustment.

In addition to a portion of the crown being movable, other embodiments include a movable layer or cover on top of the crown with one side of said movable layer or cover including the edge of an area of contrasting paint or shading of the crown 120, e.g., the first crown portion 120*a*, relative to the color or shading of the face 110 or relative to the color or shading of the second crown portion 120*b*, which can be rotated or moved sufficient to yield the desired Perceived Face Angle, PFA and/or Sight Adjusted Perceived Face Angle (SAPFA) and/or Sight Adjusted Perceived Face Angle Secondary Alignment Feature, ("$SAPFA_{SAF}$"), The movable portion of the layer or cover is again held in position by a fastening device such as a screw or bolt or other fastening means 1415, which is loosened to allow for rotation or movement and then subsequently tightened to fix the position of the movable layer or cover after adjustment.

In other embodiments a portion of the crown 120. e.g., first crown portion 120*a*, second crown portion 120*b*, or both, may comprise electronic features, e.g., electronic graphic display 1440, e.g., as illustrated in FIG. 10A, which can be selectively activated to generate the required appearance including but not limited to light emitting diodes (LED), organic LED's (OLED), printed electronics with illumination devices, embedded electronics with illumination devices, electroluminescent devices, and so-called quantum dots.

In other embodiments, a portion of the crown 120, e.g., first crown portion 120*a*, second crown portion 120*b*, or both, may comprise a coating that alters its characteristics when exposed to external conditions including but not limited to thermochromic coatings, photochromic coatings, electrochromic coatings and paramagnetic paint.

In one preferred embodiment, illustrated, e.g., with regard to FIG. 10A, at least a portion of the crown 120 of the golf club head, e.g., first crown portion 120*a*, second crown portion 120*h*, or both, or a layer covering at least a portion of the crown of the golf club head, comprises an electronic graphic display 1440. The display 1440 provides active color and graphic control for either the entire top portion of the crown 120 or layer covering at least a portion of the crown e.g., first crown portion 120*a*, second crown portion 120*b*, or both. The display 1440 may be constructed from flexible organic light-emitting diodes (OLED) displays, e-ink technology, digital fabrics, or other known means of active electronic color and graphic display means. For example, an organic light emitting diode (OLED) (e.g., a light emitting polymer (LEP), and organic electro luminescence (OEL)) is alight-emitting diode (LED) whose emissive electroluminescent layer is composed of a film of organic compounds. The layer usually contains a polymer substance that allows suitable organic compounds to be deposited in rows and columns onto a carrier substrate such as the at least a portion of the crown of the golf club head or a layer covering at least a portion of the crown of the golf club head, by a simple "printing" process. The resulting matrix of pixels can emit light of different colors.

In some embodiments, the at least a portion of the crown 120 of the golf club head, e.g., first crown portion 120*a*, second crown portion 120*b*, or both or a layer covering at least a portion of the crown of the golf club head is segmented into portions which may be controlled differently from each other. For example, one side of the alignment feature, e.g., second crown portion 120*h* or face 110, has a static surface color and the other side, e.g., first crown portion 120*a* or crown 120, a second, contrasting surface color display capability, e.g., electronic graphic display 1440.

The display 1440 is operatively connected to a microprocessor 1450 disposed in the golf club head (e.g., via wires). The microprocessor is further operatively connected to a data port 1460, for example a universal serial bus (USB) port (e.g., via wires). The data port allows transfer and retrieval of data to and from the microprocessor. Data ports and data transfer protocols are well known to one of ordinary skill in the art. The data port (e.g., a USB port) may be disposed in the rearward area of the golf club head.

Data can be obtained from a variety of sources 1480. In some embodiments, an Internet website 1484 is dedicated to support of the golf club head of the present invention. For example, the website may contain downloadable data and protocols (e.g., colors, color patterns, images, video content, logos, etc.) that can be uploaded into the microprocessor 1450 of the golf club head (via the data port 1460, via a cable, via a computer 1482). As an example, the website may have a gallery for choosing colors to be displayed, as well as patterns of the colors.

In some embodiments, data can be uploaded from other sources 1480, for example DVDs, CDs, memory devices (e.g., flash memory) 1486, and the like, Sources may also include cellular phones, smart phones, personal digital assistants (PDAs), digital vending kiosks 1488, and the like. In some embodiments, the data can be uploaded and downloaded via other mechanisms, for example, wired mechanisms 1490 or wirelessly 1495, e.g., via a wireless mechanism 1465. Such mechanisms may include Bluetooth™, infrared datalink (IrDa), Wi-Fi, UWB, and the like.

In some embodiments, as illustrated in FIG. 10A, one or more control buttons 1470 are disposed on the golf club head allowing a user to manipulate the display 1440 as desired. The control buttons are operatively connected to the microprocessor 1450. The microprocessor is configured to receive input signals from the control buttons and further send output commands to manipulate the display. The control buttons may be operatively, connected to the display and/or the microprocessor via one or more wires.

The microprocessor 1450 and/or display 1440 are operatively connected to a power source, for example a battery 1472. The battery may be rechargeable. In some embodiments, the battery comprises a control means 1474 for turning on and off the device. All wires and data ports and other electronic systems are adapted to sustain the impact forces incurred when a golfer hits a golf ball with the golf club head.

In other embodiments of the golf club heads of the present invention a method to accomplish user adjustably of the alignment feature would involve at least a portion of the crown 120 of the golf club head, e.g., first crown portion 120*a*, second crown portion 120*b*, or both, or a layer covering at least a portion of the crown of the golf club head, being covered by a dielectric electroluminescent coating system using as one example the materials and methods as described in U.S. Pat. No. 6,926,972 by M. Jakobi et al., issuing on Aug. 9, 2005 and assigned to the BASF Corporation, the entire contents of which are incorporated by reference herein. Using this technology an electric current (provided by a small battery e.g., battery 1472, fixed securely in the golf chub head cavity) could be selectively employed to use electroluminescence to highlight (or eliminate) a particular color thereby adjusting the orientation of the primary or secondary alignment features described herein.

In addition to the alignment features described herein, the golf club heads of the present invention may also incorporate additional, such features including but not limited to:

1. movable weight features including those described in more detail in U.S. Pat. Nos. 6,773,360, 7,166,040, 7,452,285, 7,628,707, 7,186,190, 7,591,738, 7,963,861, 7,621,823, 7,448,963, 7,568,985, 7,578,753, 7,717,804, 7,717,805, 7,530,904, 7,540,811, 7,407,447, 7,632,194, 7,846,041, 7,419,441, 7,713,142, 7,744,484, 7,223,180, 7,410,425 and 7,410,426, the entire contents of each of which are incorporated by reference in their entirety herein;
2. slidable weight features including those described in more detail in U.S. Pat. Nos. 7,775,905 and 8,444,505, U.S. patent application Ser. No. 13/898,313 filed on May 20, 2013, U.S. patent application Ser. No. 14/047,880 filed on Oct. 7, 2013, the entire contents of each of which are hereby incorporated by reference herein in their entirety;
3. aerodynamic shape features including those described in more detail in U.S. Patent Publication No. 2013/0123040A1, the entire contents of which are incorporated by reference herein in their entirety;
4. removable shaft features including those described in more detail in U.S. Pat. No. 8,303,431, the contents of which are incorporated by reference herein in in their entirety;
5. adjustable loft/lie features including those described in more detail in U.S. Pat. Nos. 8,025,587, 8,235,831, 8,337,319, U.S. Patent Publication No. 2011/0312437A1, U.S. Patent Publication No. 2012/0258818A1, U.S. Patent Publication No. 2012/0122601A1, U.S. Patent Publication No. 2012/0071264A1, U.S. patent application Ser. No. 13/686,677, the entire contents of which are incorporated by reference herein in their entirety; and
6. adjustable sole features including those described in more detail in U.S. Pat. No. 8,337,319, U. S. Patent Publication Nos. US2011/0152000A1, US2011/0312437, US2012/0122601A1, and U.S. patent application Ser. No. 13/686,677, the entire contents of each of which are incorporated by reference herein in their entirety.

The designs, embodiments and features described herein may also be combined with other features and technologies in the club-head including:

1. variable thickness face features described in more detail in U.S. patent application Ser. No. 12/006,060, U.S. Pat. Nos. 6,997,820, 6,800,038, and 6,824,475, which are incorporated herein by reference in their entirety;
2. composite face plate features described in more detail in U.S. patent application Ser. Nos. 11/998,435, 11/642,310, 11/825,138, 11/823,638, 12/004,386, 12/004,387, 11/960,609, 11/960,610 and U.S. Pat. No. 7,267,620, which are herein incorporated by reference in their entirety;

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A golf club head comprising:

a golf club head body having a face, a crown and a sole together defining an interior cavity, the golf club body including a heel and a toe portion and having x, y and z axes which are orthogonal to each other having their origin at USGA center face;

an electronic display for displaying one or more images, wherein the electronic display forms at least a portion of the crown and is visible to a user of the golf club head when the golf club head is in an address position;

wherein the electronic display is operably connected to a memory, a microprocessor, and a battery within the golf club head, and is configured to:

communicate with a user operable electronic device via a wireless communication protocol;

receive one or more images from the user operable electronic device, store the one or more images in the memory, and display the one or more images and sustain the impact forces incurred when a golfer hits a golf ball with the golf club head; and wherein:

the one or more images when displayed on the electronic display comprise an alignment feature that is visible to a user of the golf club head when the golf club head is in the address position;

the electronic display is formed on a first portion of the crown and forms a first side of the alignment feature, and a second portion of the crown forms a second side of the alignment feature;

both sides of the alignment feature are visible to a user of the golf club head when the golf club head is in the address position; and the electronic display is configured to be manipulated to adjust its orientation relative to the second portion of the crown.

2. The golf club head of claim 1, wherein the electronic display comprises a flexible organic light-emitting diode (OLED) screen.

3. The golf club head of claim 1, wherein the electronic display is flexible.

4. The golf club head of claim 3, wherein the golf club head is a driver type golf club head.

5. The golf club head of claim 4, wherein the electronic display comprises an e-ink display.

6. The golf club head of claim 1, wherein the golf club head is a putter type golf club head.

7. The golf club head of claim 1, wherein the user operable electronic device is a smartphone.

8. The golf club head of claim 1, wherein the one or more images are received via an internet website.

9. The golf club head of claim 1, wherein the one or more images comprise a video.

10. The golf club head of claim 1, wherein the first side of the alignment feature formed by the electronic display is configured such that adjusting its orientation adjusts the user's Sight Adjusted Perceived Face Angie of a secondary alignment feature.

11. The golf club head of claim 1, wherein the alignment feature delineates a transition between at least a first portion of the crown having an area of contrasting shade or color with a shade or color of the face.

12. The golf club head of claim 11, wherein the alignment feature is curved.

13. The golf club head of claim 1, wherein the face comprises a composite face plate.

14. A golf club head comprising:

a golf club head body having a face, a crown and a sole together defining an interior cavity, the golf club body including a heel and a toe portion and having x, y and z axes which are orthogonal to each other having their origin at USGA center face;

the crown having a top surface as viewed from an address position;

an electronic feature provided on or covering at least a portion of the top surface of the crown wherein the electronic feature is integrated into, and forms at least a portion of the crown; and a striking surface situated so as to define an interface with the crown;

wherein:

the electronic feature is provided so as to generate an alignment feature on the crown proximate the interface with the striking surface;

the electronic feature forms at least a first side of the alignment feature, while the striking surface forms at least a portion of a second side of the alignment feature;

both sides of the alignment feature are visible to a user of the golf club head when the golf club head is in the address position;

the alignment feature generated by the electronic feature is configured to be manipulated to adjust a user's Sight Adjusted Perceived Face Angie by modifying an orientation of the first side of the alignment feature relative to the second side of the alignment feature proximate the interface to adjust the user's perception of the angle of the interface relative to a target line; and the electronic feature is configured to receive the alignment feature via a wireless communication protocol communicated from a user operable software package.

15. The golf club head of claim 14, wherein the electronic feature comprises a flexible display.

16. The golf club head of claim 15, wherein the flexible display comprises an e-ink display.

17. The golf club head of claim 14, wherein the golf club head is a driver type golf club head.

18. The golf club head of claim 14, wherein the alignment feature has:

a Sight Adjusted Perceived Face Angle (SAPFA) of from about −2 to about 10 degrees;

a Sight Adjusted Perceived Face Angle 25 mm Heelward (SAPFA25H) of from about −5 to about 2 degrees;

a Sight Adjusted Perceived Face Angle 25 mm Toeward (SAPFA25T) of from 0 to about 9 degrees; and a Radius of Curvature (circle fit) of from about 300 to about 1000 mm.

19. The golf club head of claim 18, wherein the electronic feature comprises a flexible display.

20. The golf club head of claim 19, wherein the flexible display comprises an e-ink display.

21. The golf club head of claim 20, wherein a forward edge of the electronic feature is positioned forward of at least a portion of a hosel of the golf club head.

22. The golf club head of claim 14, wherein a forward edge of the electronic feature is positioned forward of at least a portion of a hosel of the golf club head.

23. A golf club head comprising:

a golf club head body having a face, a crown and a sole together defining an interior cavity, the golf club body including a heel and a toe portion and having x, y and z axes which are orthogonal to each other having their origin at USGA center face;

an electronic display for displaying one or more images, wherein the electronic display forms at least a portion of the crown and is visible to a user of the golf club head when the golf club head is in an address position;

wherein the electronic display is operably connected to a memory, a microprocessor, and a battery within the golf club head, and is configured to:

communicate with a user operable electronic device via a wireless communication protocol, receive one or more images from the user operable electronic device, store the one or more images in the memory, and display the one or more images;

wherein the user operable electronic device is separate from the golf club head; and wherein:

the one or more images when displayed on the electronic display comprise an alignment feature that is visible to a user of the golf club head when the golf club head is in the address position:

the electronic display forms a first side of the alignment feature, while the face forms a second side of the alignment feature, and wherein both sides of the alignment feature are visible to a user of the golf club head when the golf dub head is in the address position; and the first side of the alignment feature formed by the electronic display is configured to be manipulated to adjust an orientation of the alignment feature relative to the second side of the alignment feature.

24. The golf club head of claim 23, wherein the golf club head is a putter type golf club head, and the user operable electronic device is a smartphone.

25. The golf club head of claim 23, wherein the electronic display comprises a segmented, e-ink display.

26. The golf club head of claim 23, wherein the electronic display comprises a flexible e-ink display.

27. The golf club head of claim 26, further comprising one or more control buttons disposed on the golf club head and operatively connected to the electronic display.

28. The golf club head of claim 23, wherein the first side of the alignment feature formed by the electronic display is configured such that adjusting its orientation adjusts a user's Sight Adjusted Perceived Face Angle.

29. The golf club head of claim 23, wherein the golf club head is a driver type golf club head.

30. The golf club head of claim 23, wherein the face forms a portion of the second side of the alignment feature.

31. The golf club head of claim 23, wherein the face forms the entire second side of the alignment feature.

* * * * *